US010864523B2

(12) United States Patent
Rogers et al.

(10) Patent No.: US 10,864,523 B2
(45) Date of Patent: Dec. 15, 2020

(54) SHREDDER BLADE ASSEMBLY

(71) Applicant: Eco Green Equipment, LLC, North Salt Lake, UT (US)

(72) Inventors: Ted Bushman Rogers, Bountiful, UT (US); Michael Bradley Swenson, Salt Lake City, UT (US)

(73) Assignee: ECO GREEN EQUIPMENT, LLC, North Salt Lake, UT (US)

( * ) Notice: Subject to any disclaimer, the term of this patent is extended or adjusted under 35 U.S.C. 154(b) by 1846 days.

(21) Appl. No.: 14/282,093

(22) Filed: May 20, 2014

(65) Prior Publication Data

US 2015/0336103 A1 Nov. 26, 2015

(51) Int. Cl.
*B02C 18/18* (2006.01)
*B02C 18/14* (2006.01)

(52) U.S. Cl.
CPC ..... *B02C 18/18* (2013.01); *B02C 18/142* (2013.01); *B02C 18/184* (2013.01); *B02C 2210/02* (2013.01)

(58) Field of Classification Search
CPC ..... B02C 18/18; B02C 18/184; B02C 18/142
USPC ..... 241/236, 292.1, 235, 294, 295
See application file for complete search history.

(56) References Cited

U.S. PATENT DOCUMENTS 1,013,509 A * 1/1912 Nelson ..... B02C 18/186 241/242
1,032,081 A * 7/1912 Penn ..... B02C 4/12 241/239
2,141,663 A * 12/1938 Ossing ..... B02C 18/0092 144/233
3,229,921 A * 1/1966 Hess ..... B02C 18/14 241/190
3,367,585 A * 2/1968 Ratkowski ..... B02C 13/28 241/197
3,595,290 A * 7/1971 Tassev ..... B02C 11/00 241/154
3,658,265 A * 4/1972 Johnson ..... B02C 18/145 241/190
4,241,882 A * 12/1980 Baikoff ..... B02C 18/184 241/191
4,350,308 A * 9/1982 Brewer ..... B02C 18/184 144/237

(Continued)

FOREIGN PATENT DOCUMENTS

SU 961770 A 9/1982

*Primary Examiner* — Sean M Michalski
(74) *Attorney, Agent, or Firm* — Kirton McConkie; Evan R. Witt

(57) ABSTRACT

A shredder blade assembly is disclosed having a rotor configured to be mounted on a rotating shaft, the rotor having opposing faces with a plurality of angled knife receptacles and a plurality of knife inserts mounted within the plurality of knife receptacles. Each knife insert has two opposing faces and each opposing face comprises three cutting edges such that each knife insert has six cutting edges. Only one of the cutting edges is exposed at an outer peripheral edge of the shredder blade assembly during use. The knife inserts are configured to be removed, rotated (and flipped as needed), and re-mounted within the plurality of knife receptacles to expose another of the cutting edges at the outer peripheral edge of the shredder blade assembly. The knife insert may be triangular and mounted to expose one vertex to create a plurality of tooth/hook projections.

19 Claims, 6 Drawing Sheets

(56) References Cited

U.S. PATENT DOCUMENTS 4,374,573 A * 2/1983 Rouse ..... B02C 18/142 241/101.76
4,607,800 A * 8/1986 Barclay ..... B02C 18/0084 241/159
4,717,085 A * 1/1988 Crane ..... B02C 18/0007 241/236
4,773,600 A * 9/1988 Metski ..... B02C 18/145 241/101.76
4,799,627 A * 1/1989 Potts ..... B02C 18/142 241/197
4,834,302 A * 5/1989 Baker ..... B02C 13/04 241/101.78
4,901,929 A * 2/1990 Barclay ..... B02C 18/142 241/236
4,945,640 A * 8/1990 Garg ..... C23C 16/08 30/350
4,981,270 A * 1/1991 Reber ..... B02C 18/0007 241/166
5,042,733 A * 8/1991 Hench ..... B02C 18/186 144/231
5,275,342 A * 1/1994 Galanty ..... B02C 18/142 241/236
5,285,973 A * 2/1994 Goforth ..... B02C 18/182 241/236
5,318,231 A * 6/1994 Bernhardt ..... B02C 18/184 241/236
5,375,775 A * 12/1994 Keller ..... B02C 18/144 241/101.4
5,680,999 A * 10/1997 Wada ..... B02C 18/142 241/236
5,873,534 A * 2/1999 Shinn ..... A01G 23/093 241/294
6,024,312 A * 2/2000 Spiesshofer ..... B02C 18/142 241/166
6,053,442 A * 4/2000 Matsuo ..... B02C 18/14 241/154
6,176,445 B1 * 1/2001 Shinn ..... A01G 23/067 241/294
6,375,106 B1 * 4/2002 Sears ..... B02C 18/142 241/236
6,439,486 B1 * 8/2002 Nitta ..... B02C 1/04 241/159
7,100,855 B2 * 9/2006 Diemunsch ..... B02C 18/142 241/236
7,124,969 B2 * 10/2006 Lietaer ..... A01G 3/002 241/89.3
7,334,748 B2 * 2/2008 Maynard ..... B02C 18/145 241/243
7,418,986 B2 * 9/2008 Watts ..... B02C 18/184 144/24.12
7,500,630 B2 * 3/2009 Rogers ..... B02C 18/142 241/236
7,975,945 B1 * 7/2011 Lo ..... B02C 18/0007 241/166
D655,731 S * 3/2012 Cox ..... B02C 18/145 D15/139
8,167,225 B2 * 5/2012 Gaudreault ..... A01D 34/835 241/101.77
8,646,714 B2 * 2/2014 Chen ..... B02C 18/0007 144/231
8,646,715 B2 * 2/2014 Pellman ..... B02C 18/18 241/101.76
8,919,683 B2 * 12/2014 Kim ..... B02C 18/145 241/243
8,967,515 B2 * 3/2015 Pallmann ..... B02C 18/145 241/291
9,016,284 B2 * 4/2015 Tilley ..... B02C 18/145 131/280
9,561,551 B2 * 2/2017 Diego ..... B02C 18/18
9,573,137 B2 * 2/2017 Van der Galien ..... B02C 4/34
9,776,192 B2 * 10/2017 Ebadian ..... B02C 18/186
2002/0074436 A1 * 6/2002 Hruska ..... A01F 29/005 241/194
2004/0251360 A1 * 12/2004 Everson ..... B02C 4/20 241/294
2009/0008491 A1 * 1/2009 Sharp ..... B02C 18/18 241/294
2011/0108650 A1 * 5/2011 Lin ..... B02C 18/0007 241/236
2016/0288353 A1 * 10/2016 McCracken ..... B26D 1/29
2017/0095821 A1 * 4/2017 Lyman ..... B02C 13/04
2017/0252749 A1 * 9/2017 Miller ..... B02C 18/18

* cited by examiner

A3

SECTION B/3 – B/3

SECTION C/4-C/4

SHREDDER BLADE ASSEMBLY

BACKGROUND OF THE INVENTION

This disclosure relates to a shredder blade assembly that includes interchangeable knife inserts with six cutting edges.

BACKGROUND

Industrial shredding machines are used to shred or reduce objects into smaller pieces for reuse or recycle. Shredding machines are commonly rotary shredders comprising pairs of counter-rotating, intermeshing, serrating and shearing blade assemblies or cutting wheels. The blade assemblies are mounted on parallel rotating shafts. The number of pairs of parallel blade assemblies on a single shaft can vary. A larger number of blade assemblies will increase the capacity of the shredder. The parallel blade assemblies are separated by spacers to allow intermeshing of another set of parallel blade assemblies on another shaft.

In the shredding zone, the tire or article to be shredded encounters the outer periphery of the counter-rotating blade assemblies. After continuous shredding for a period of time, the outer periphery of the blade assembly becomes worn by the toughness of tires or articles being shredded. These cutting or shearing surfaces would need to be resurfaced. The problem of resurfacing cutting wheels has been addressed by using a modular construction of blade assemblies comprising a rotor structure upon which a plurality of cutting and shearing surfaces are attached. The outer peripheral contact region of a blade assembly is removed and replaced instead of removing the entire wheel from its shaft for repair. This is done by removing individual cutting and shearing surfaces, or knives, from the rotor.

It will be appreciated that there is a need in the art for shredder blade assemblies that can be quickly and efficiently maintained to reduce equipment down-time and expensive repair on industrial shredders.

It will further be appreciated that there is a need in the art for shredder blade assemblies with replaceable knife inserts that have a long usable lifespan, thereby lowering maintenance costs.

SUMMARY OF THE INVENTION

A shredder blade assembly is disclosed that includes a rotor upon which are mounted interchangeable knife inserts.

Each knife insert has six cutting or shearing edges. It may have a triangular or modified-triangular shape. During shredder operation, only one of the six cutting edges is subject to wear. After one cutting edge is worn, the knife insert is rotated 120°, thereby exposing another edge. The knife insert may be rotated to expose the three cutting edges on one side of the knife insert. After all three cutting edges on one side are worn, the entire knife insert is flipped over and rotated as needed to expose three additional cutting edges. The knife inserts are held in place by a symmetrical hole pattern that enables correct placement and bolting of the knife insert onto the rotor despite being rotated and flipped.

The knife inserts are preferably fabricated of a high alloy steel and/or tool steel. The knife inserts may optionally be coated with wear resistant surface coatings. The knife inserts may optionally be fabricated with carbide wear edges.

When the knife insert is inserted onto the rotor its triangle shape and the way it is inserted onto the rotor creates a positive angle tooth/hook, much like a saw tooth, that pulls material through the opposing cutting edges more efficiently than other insert types.

In one non-limiting embodiment, the knife inserts are staggered on each side of the rotor so that the teeth/hooks are offset to create a smoother flow of material into the blade assembly as they cut, shear, and shred the material. Without being bound by theory, it is believed that the smoother flow of material into the blade assembly produces less stress and wear on the gears and motors that drive the shredder.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the shredder blade assembly, is not intended to limit the scope of the invention, as claimed, but is merely representative of present embodiments of the invention.

Figure 1B:
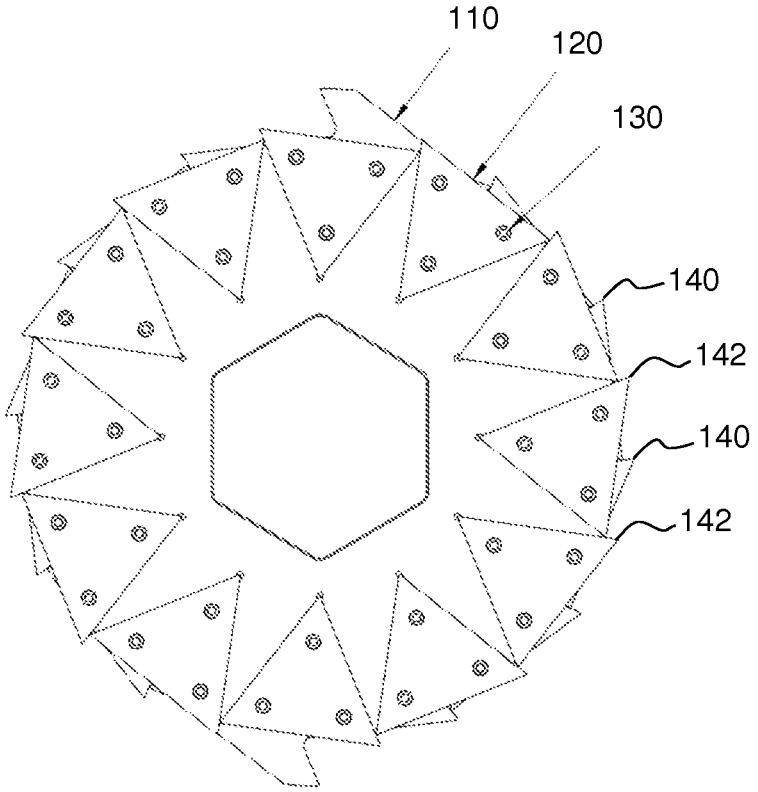
FIGS. 1A, 1B, and 1C are front perspective, front, and side views, respectively, of a shredder blade assembly within the scope of the disclosed invention.
Figure 1C:
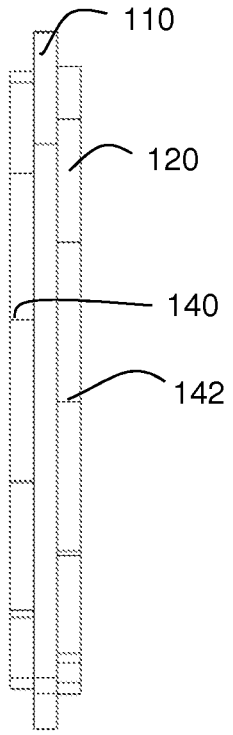
Figure 1A:
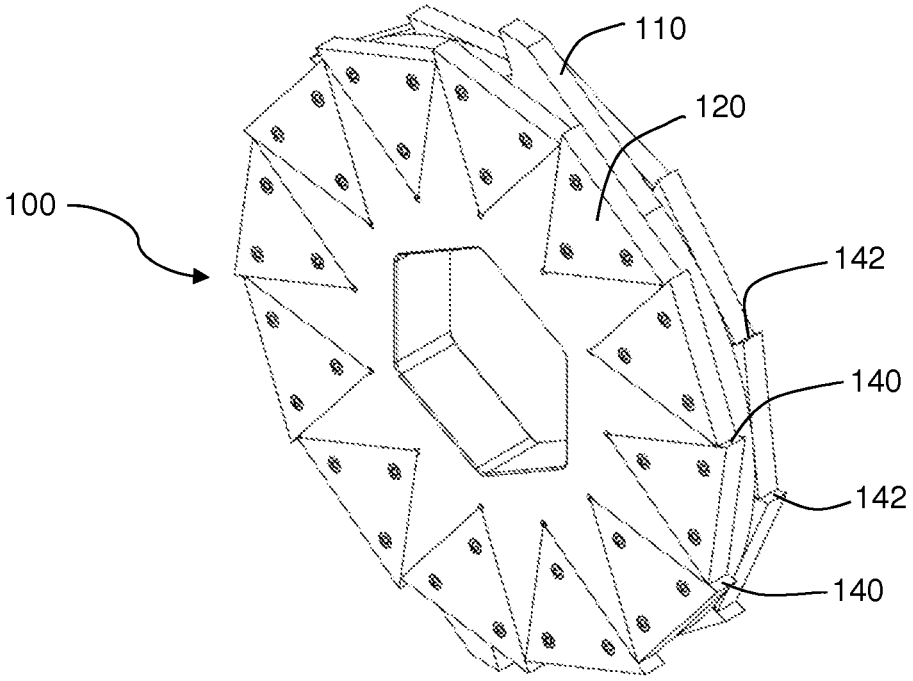

The disclosed invention relates to a shredder blade assembly having interchangeable knife inserts. One non-limiting embodiment of a shredder blade assembly 100 is shown in FIGS. 1A, 1B, and 1C. The shredder blade assembly includes a rotor 110 upon which are mounted a plurality of knife inserts 120. In the illustrated embodiment, 12 knife inserts 120 are mounted on one side of the rotor 110 and 12 other knife inserts 120 are mounted on the opposite side of the rotor 110. It will be appreciated that the number of knife inserts mounted on each rotor may be varied. Thus, the invention is not limited to the specific number of knife inserts shown in the Figures.

The knife inserts 120 are mounted to the rotor using suitable fasteners 130. The fasteners 130 may be screws, such as socket head cap screws. As shown, each rotor may be mounted using screws in a symmetrical screw hole pattern. A symmetrical hole pattern enables correct placement and bolting of the knife insert 120 onto the rotor 110 despite being rotated and flipped. In one disclosed embodiment, three fasteners 130 are used to mount each knife insert 120. In another embodiment, a single centrally located fastener may be used to mount each knife insert 120. It is understood that precise number of holes and fasteners used may vary.

The disclosed knife inserts 120 are preferably made in the shape of an equilateral triangle. They are mounted in a way to expose one vertex of the triangle to create a positive angle tooth/hook 140, 142 much like a saw tooth, that pulls material through the opposing cutting edges more efficiently than other shredder blade insert types. It will be understood that the shape of the knife inserts may be modified to another polygonal shape and still provide six cutting and shearing edges. For instance, the knife insert may have a modified triangular shape, such as a hexagonal shape. As used herein, a modified triangular shape includes a shape that still has three dominant sides or edges, but may not be "technically" a triangle. A modified triangular shape that is hexagonal may be achieved by removing a portion of each vertex of the equilateral triangle. The precise angle and amount removed from each vertex may vary.

In one non-limiting embodiment, the knife inserts are staggered on the each side of the rotor so that the teeth/hooks 140, 142 are offset to create a smoother flow of material into the shredder blade assemblies as they cut, shear, and shred the material. Without being bound by theory, it is believed that the smoother flow of material into the blade assembly produces less stress and wear on the gears and motors that drive the shredder.

Figure 2B:
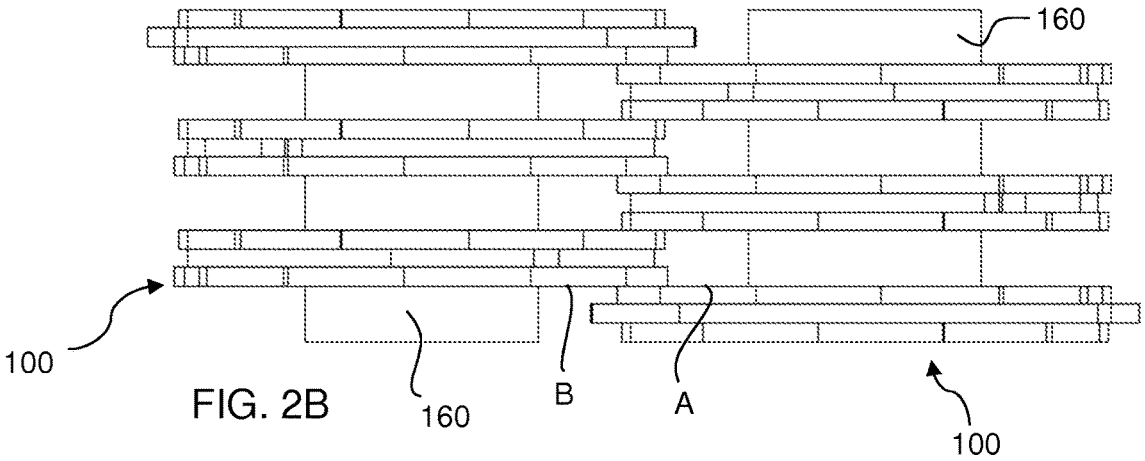
FIGS. 2A and 2B are front and top plan views, respectively, of shredder blade assemblies mounted on shafts.
Figure 2A:
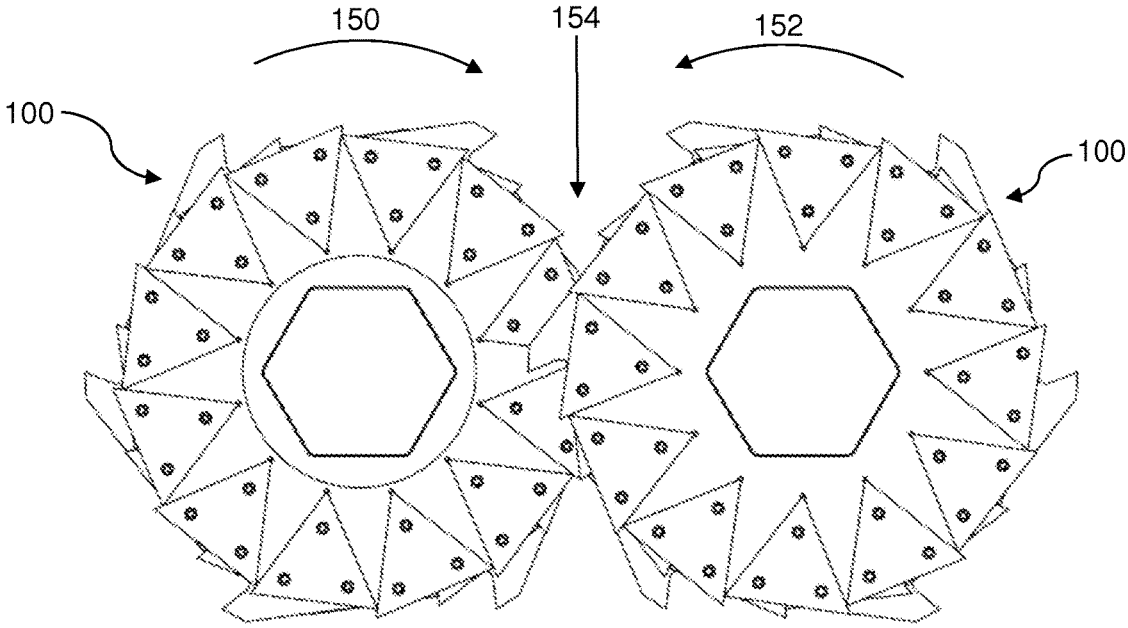

Rotary shredders comprise pairs of counter-rotating, intermeshing, serrating and shearing blade assemblies. FIG. 2A shows a front view and 2B shows a top view of shredder blade assemblies 100 mounted on parallel rotatable shafts. The number of pairs of parallel blade assemblies on a single shaft can vary. A larger number of blade assemblies will increase the capacity of the shredder. It will be appreciated that the number of blade assemblies 100 shown in FIG. 2B is for illustration purposes. The actual number of blade assemblies 100 in a working rotary shredder would typically be greater than the number illustrated in FIG. 2B.

Each shaft rotates in an opposite direction, as shown by arrows 150, 152 so that the article to be shredded is drawn into a shredding zone indicated by arrow 154. Within the shredding zone 154, the exposed outer edge of knife inserts on one blade assembly 100 (identified as "A" in FIG. 2B) contact and interact with the exposed outer edge of knife inserts on the opposed and adjacent blade assembly rotating in the opposite direction (identified as "B" in FIG. 2B). The interacting outer edges cut, shear, or shred the article.

Figure 7B:
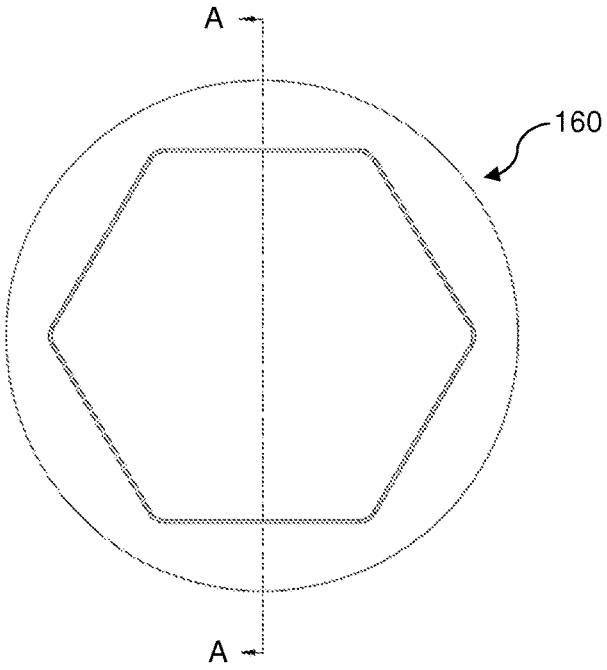
FIGS. 7A, 7B, and 7C are a front perspective, a front, and a cross-section view (taken along line A-A of FIG. 7B), respectively, of a blade assembly spacer within the scope of the disclosed invention.
Figure 7C:
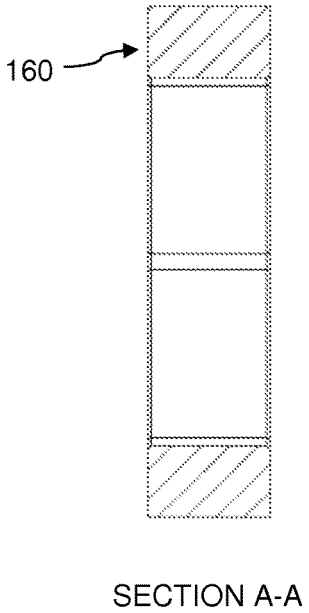
Figure 7A:
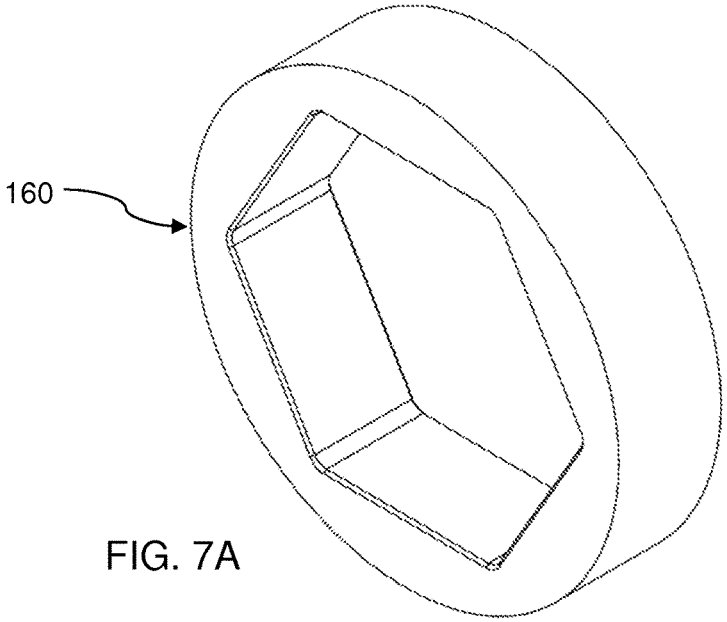

The parallel blade assemblies are separated by spacers 160 to allow proper spacing and intermeshing of an opposing set of parallel blade assemblies on another shaft. The width or thickness of the spacers may vary as needed to ensure that opposing blade assemblies interact to produce the cutting, shearing, or shredding function. A representative example of a blade assembly spacer is shown in FIGS. 7A-7C.

Figure 3B:
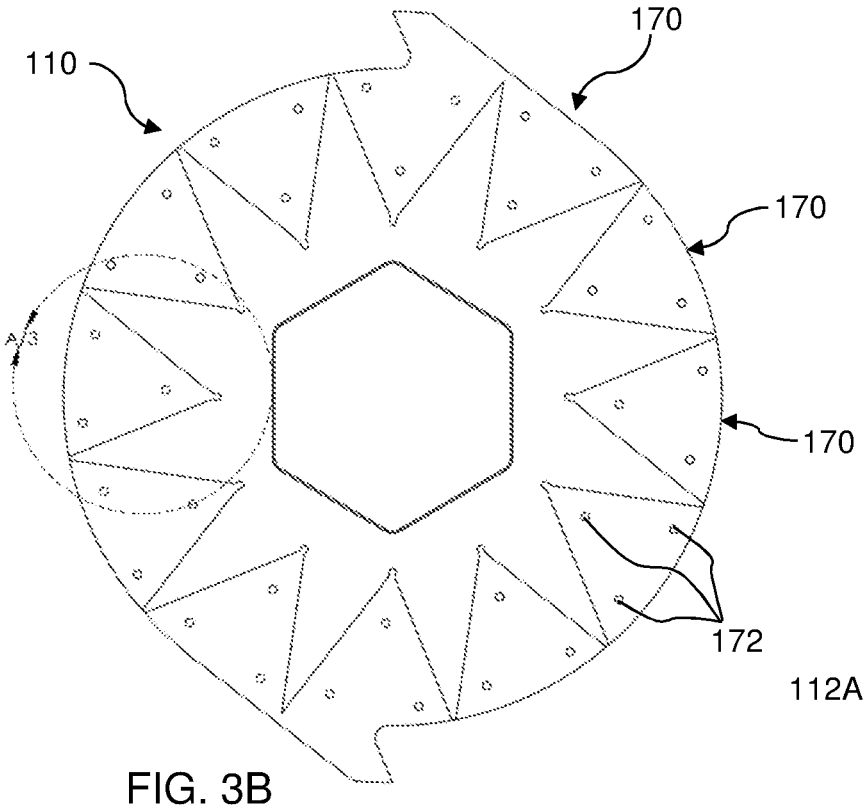
FIGS. 3A, 3B, and 3C are front perspective, front, and side views, respectively, of a rotor within the scope of the disclosed invention.
Figure 3C:
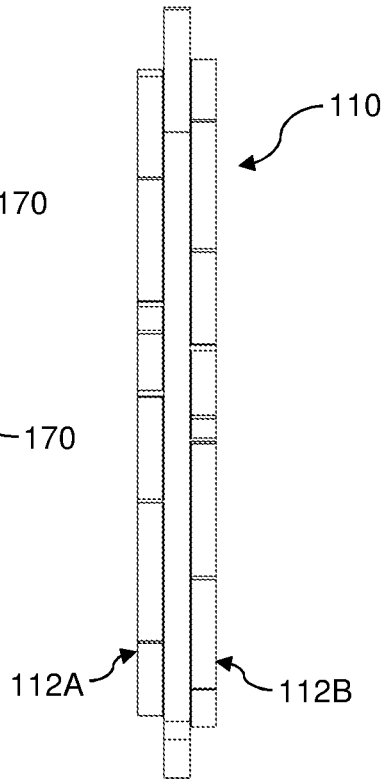
Figure 3A:
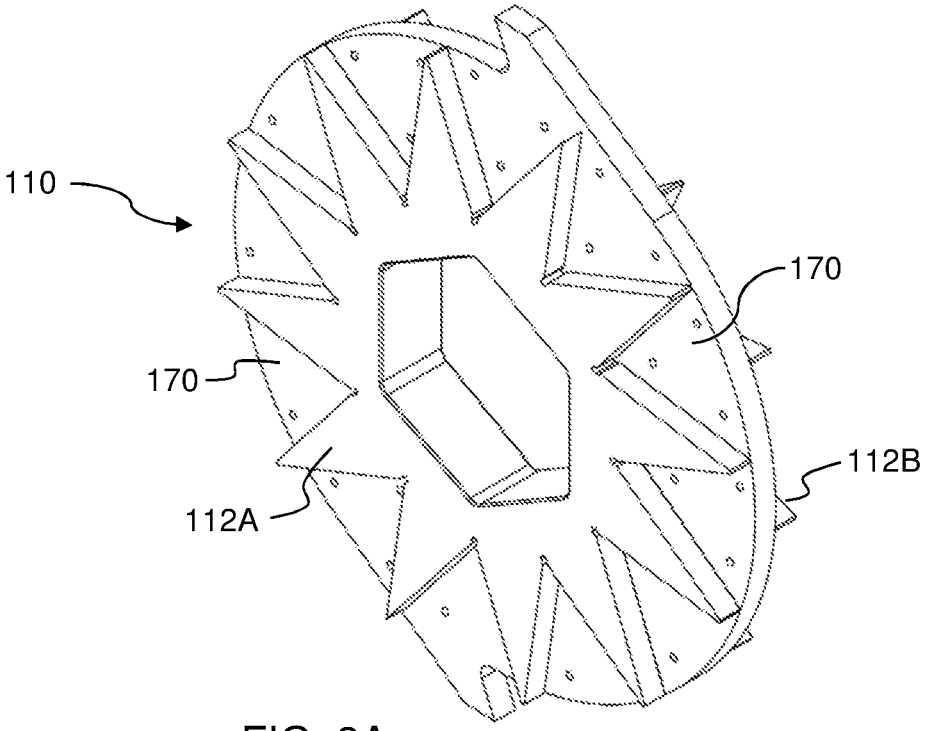

FIGS. 3A-3C illustrate one non-limiting example of a rotor 110 within the scope of the disclosed invention. The rotor 110 is fabricated or machined to include a plurality of knife receptacles 170 sized and configured to receive a plurality of triangular knife inserts mounted on opposing faces 112A and 1128 on opposite sides of the rotor 110. While the illustrated embodiment of the rotor 110 may accommodate 12 knife inserts mounted on each side or opposing face, it is understood that the rotor can be fabricated to accommodate any practical number of knife inserts.

Each knife receptacle includes one or more holes 172 disposed in a symmetrical hole pattern to receive suitable fasteners used to mount a knife insert. As described above, the symmetrical hole pattern enables correct placement and bolting of knife insert onto the rotor 110 despite being rotated and flipped.

Figure 4:
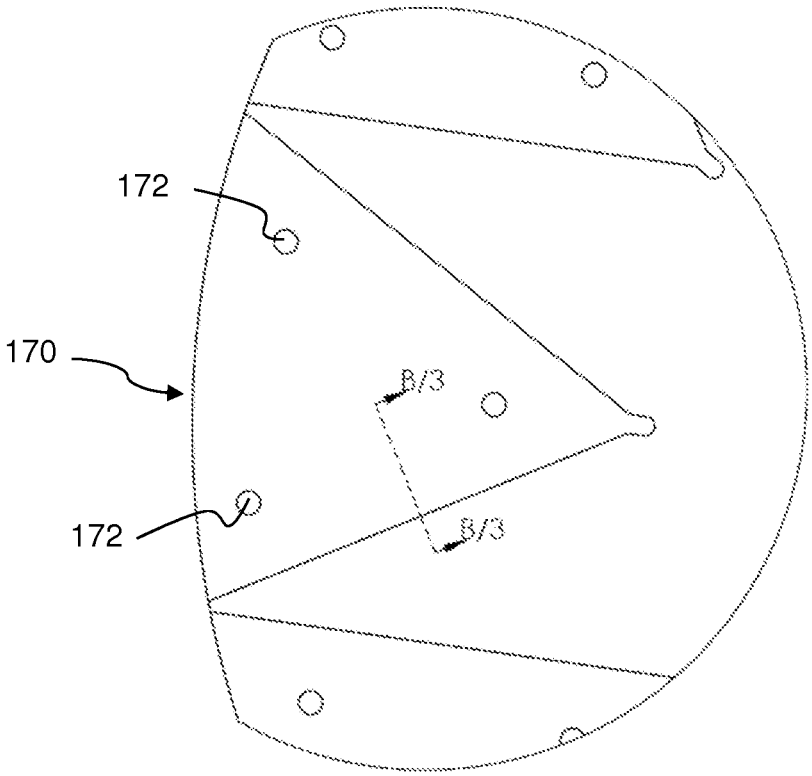
FIG. 4 is an enlarged view of region A3 identified in FIG. 3B.
Figure 5:
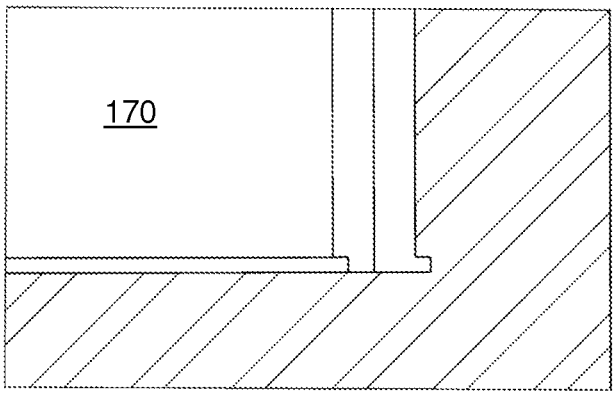
FIG. 5 is an enlarged partial cross-sectional view taken along line B3-B3 of FIG. 4.

FIG. 4 is an enlarged view of the knife receptacle 170 shown in the region A3 identified in FIG. 3B. FIG. 5 is an enlarged partial cross-sectional view taken along line B3-B3 of FIG. 4.

Figure 6B:
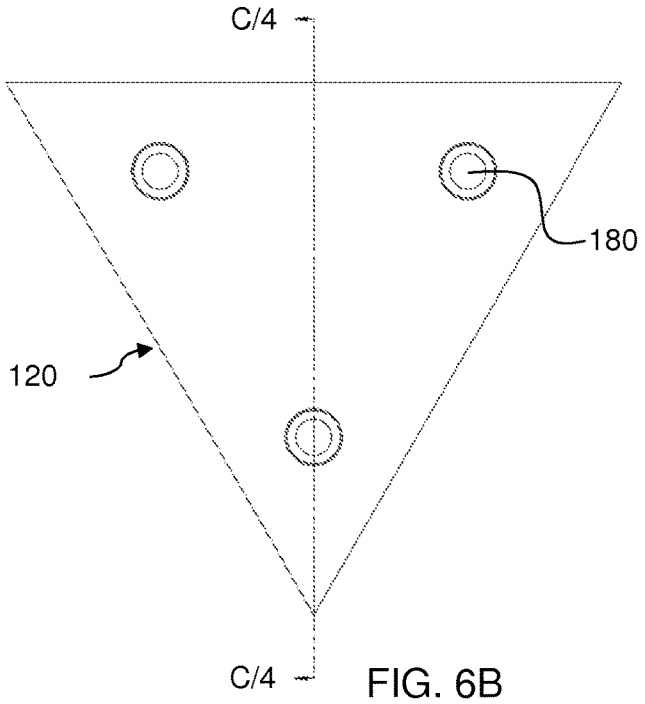
FIGS. 6A, 6B, and 6C are a front perspective, a front, and a cross-sectional view (taken along line C4-C4 of FIG. 6B), respectively, of a knife insert within the scope of the disclosed invention.
Figure 6C:
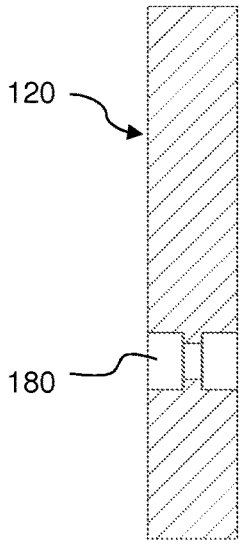
Figure 6A:
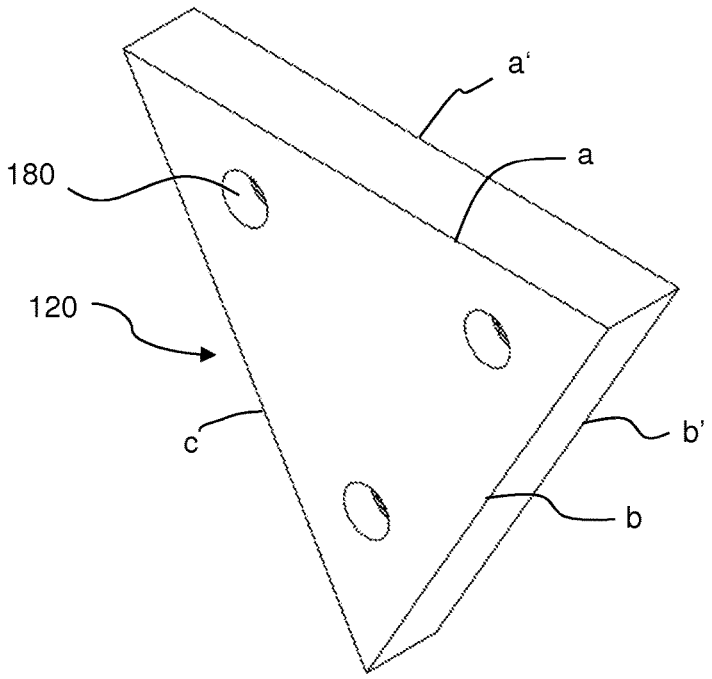

FIGS. 6A-6C show details of a knife insert 120. As described above, each knife insert 120 is triangular shaped, thereby providing six cutting or shearing edges, labelled in FIG. 6A as edges a, b, c on one side and edges a' and b' on the opposite side, with edge c' being hidden in the perspective view by edge c. During shredder operation, only the exposed outer edge of each knife insert is subject to wear. Thus, only one of the six edges is subject to wear during shredder operation. After one cutting edge is worn, the knife insert is removed from the rotor, rotated 120°, and reinstalled to the rotor, thereby exposing another edge. The knife insert 120 is rotated as needed to expose the three cutting edges on one side of the knife insert. After all three cutting edges on one side are worn, the entire knife insert 120 is flipped over and rotated as needed to expose three additional cutting edges.

The ability to use a knife insert with six cutting or shearing edges greatly extends the useful life of the knife insert. This can reduce operating and maintenance costs for the shredder.

The knife inserts 120 are mounted to the rotor by fasteners 130 using holes 180 arranged in a symmetrical hole pattern that enables correct placement and bolting of the knife insert 120 onto the rotor 110 despite being rotated and flipped, as described above.

The knife inserts are preferably fabricated of a high alloy steel and/or hardened tool steel. The knife inserts may optionally be coated with wear resistant surface coatings. In a non-limiting embodiment, the knife inserts are fabricated with carbide wear edges.

While specific embodiments and examples of the present invention have been illustrated and described, numerous modifications come to mind without significantly departing from the spirit of the invention, and the scope of protection is only limited by the scope of the accompanying claims.

The invention claimed is:

1. A shredder blade assembly comprising:

a rotor configured to be mounted on a rotating shaft, the rotor having opposing faces, wherein each opposing face includes a plurality of angled knife receptacles; and a plurality of triangular knife inserts removably mounted to the votoiwithin the plurality of knife receptacles, wherein the knife inserts are mounted to expose one vertex of the triangular knife insert at an outer circumference of the blade assembly to create a plurality of tooth/hook projections and wherein the knife inserts are configured to be removed, rotated, and re-mounted to the rotor within the plurality of knife receptacles.

2. The shredder blade assembly according to claim 1, wherein the plurality of tooth/hook projections of the knife inserts mounted on each opposing face are staggered.

3. The shredder blade assembly according to claim 1, wherein the knife inserts are configured in the shape of an equilateral triangle.

4. The shredder blade assembly according to claim 1, wherein the knife inserts and the knife receptacles comprise symmetrical hole patterns for fastening the knife inserts to the rotor.

5. The shredder blade assembly according to claim 1, wherein the knife inserts are also configured to be removed, flipped, and re-mounted within the plurality of knife receptacles.

6. The shredder blade assembly according to claim 1, wherein the knife inserts are fabricated of high alloy steel or tool steel.

7. The shredder blade assembly according to claim 1, wherein the knife inserts are coated with a wear resistant coating.

8. The shredder blade assembly according to claim 1, wherein the knife inserts comprise carbide wear edges.

9. A rotary shedder shredder machine comprising a plurality of pairs of shredder blade assemblies as defined in claim 1, wherein the shredder blade assemblies are mounted on counter rotating parallel shafts, wherein the shredder blade assemblies are spaced apart by a plurality of spacers to enable outer peripheral cutting edges of the blade assemblies mounted on one shaft to engage outer peripheral cutting edges of corresponding blade assemblies mounted on the other shaft.

10. A shredder blade assembly comprising:

a rotor configured to be mounted on a rotating shaft, the rotor having opposing faces, wherein each opposing face includes a plurality of angled knife receptacles; and a plurality of knife inserts mounted to the rotor within the plurality of knife receptacles, wherein each knife insert has two opposing faces and each opposing face comprises three cutting edges configured such that only one of the cutting edges is exposed at an outer peripheral edge of the shredder blade assembly, and wherein the knife inserts are configured to be removed, rotated, and re-mounted to the rotor within the plurality of knife receptacles to expose another of the cutting edges at the outer peripheral edge of the shredder blade assembly.

11. The shredder blade assembly according to claim 10, wherein the knife inserts are triangular and are mounted to expose one vertex of the triangular knife insert at an outer circumference of the blade assembly to create a plurality of tooth/hook projections.

12. The shredder blade assembly according to claim 11 wherein the plurality of tooth/hook projections of the knife inserts mounted on each opposing face are staggered.

13. The shredder blade assembly according to claim 10, wherein the knife inserts are configured in a modified triangular shape.

14. The shredder blade assembly according to claim 10, wherein the knife inserts and the knife receptacles comprise symmetrical hole patterns for fastening the knife inserts to the rotor.

15. The shredder blade assembly according to claim 10, wherein the knife inserts are also configured to be removed, flipped, and re-mounted within the plurality of knife receptacles.

16. The shredder blade assembly according to claim 10, wherein the knife inserts are fabricated of high alloy steel or tool steel.

17. The shredder blade assembly according to claim 10, wherein the knife inserts are coated with a wear resistant coating.

18. The shredder blade assembly according to claim 10, wherein the knife inserts comprise carbide wear edges.

19. A rotary shredder machine comprising a plurality of pairs of shredder blade assemblies as defined in claim 10, wherein the shredder blade assemblies are mounted on counter rotating parallel shafts, wherein the shredder blade assemblies are spaced apart by a plurality of spacers to enable outer peripheral cutting edges of the blade assemblies mounted on one shaft to engage outer peripheral cutting edges of corresponding blade assemblies mounted on the other shaft.

* * * * *